US008044377B2

(12) United States Patent
Helle et al.

(10) Patent No.: US 8,044,377 B2
(45) Date of Patent: Oct. 25, 2011

(54) SHIELDED CONTAINER

(75) Inventors: Kevin Helle, Bartlett, IL (US); Jay Reed, Elk Grove Village, IL (US); Michael T. Schneider, Crystal Lake, IL (US)

(73) Assignee: Medi-Physics, Inc., Princeton, NJ (US)

( * ) Notice: Subject to any disclaimer, the term of this patent is extended or adjusted under 35 U.S.C. 154(b) by 208 days.

(21) Appl. No.: 12/518,109

(22) PCT Filed: Dec. 18, 2007

(86) PCT No.: PCT/US2007/087850

§ 371 (c)(1), (2), (4) Date: Jun. 8, 2009

(87) PCT Pub. No.: WO2008/077004

PCT Pub. Date: Jun. 26, 2008

(65) Prior Publication Data

US 2010/0019174 A1 Jan. 28, 2010

(51) Int. Cl.
*G21F 5/00* (2006.01)

(52) U.S. Cl. ..... 250/515.1; 250/505.1; 250/506.1; 250/507.1

(58) Field of Classification Search ..... 250/505.1, 250/506.1, 507.1, 515.1
See application file for complete search history.

(56) References Cited

U.S. PATENT DOCUMENTS 3,347,711 A * 10/1967 Banks, Jr. et al. ..... 136/202
3,389,258 A * 6/1968 Reed et al. ..... 250/517.1
4,274,007 A * 6/1981 Baatz et al. ..... 250/506.1
4,275,683 A * 6/1981 Kutz et al. ..... 118/407
4,388,268 A * 6/1983 Knackstedt et al. ..... 376/272
4,410,802 A * 10/1983 Szulinski ..... 250/515.1
4,447,730 A * 5/1984 Botzem et al. ..... 250/506.1
4,447,733 A * 5/1984 Baatz et al. ..... 250/506.1
4,453,081 A * 6/1984 Christ et al. ..... 250/506.1
4,847,505 A * 7/1989 Suthanthiran ..... 250/507.1
4,869,299 A * 9/1989 Handke ..... 141/1
5,042,679 A * 8/1991 Crowson et al. ..... 220/259.3
5,061,858 A * 10/1991 Mallory ..... 250/507.1
5,145,063 A * 9/1992 Lee ..... 206/364
5,519,931 A * 5/1996 Reich ..... 29/426.3
5,531,341 A * 7/1996 Shlisky ..... 215/308
5,536,945 A * 7/1996 Reich ..... 250/507.1
5,672,883 A * 9/1997 Reich ..... 250/507.1
5,796,109 A * 8/1998 Frederick et al. ..... 250/368
5,927,351 A * 7/1999 Zhu et al. ..... 141/330
6,722,499 B2 * 4/2004 Reich ..... 206/365
6,781,142 B2 * 8/2004 Hutcheson ..... 250/506.1
6,926,657 B1 * 8/2005 Reed et al. ..... 600/3
7,001,326 B2 * 2/2006 Reed et al. ..... 600/7
7,170,072 B2 * 1/2007 Schwarz et al. ..... 250/507.1
7,268,359 B2 * 9/2007 Fu et al. ..... 250/507.1
7,414,254 B2 * 8/2008 Polsinelli et al. ..... 250/507.1
7,495,246 B2 * 2/2009 Fago et al. ..... 250/506.1
7,628,287 B1 * 12/2009 Arnold ..... 220/62.22

(Continued)

FOREIGN PATENT DOCUMENTS

DE 4120287 1/1992

(Continued)

*Primary Examiner* — David A Vanore
(74) *Attorney, Agent, or Firm* — Robert F. Chisholm

(57) ABSTRACT

The present invention provides a radiation-shielding container for a radiopharmaceutical that may be magnetically picked and placed, assembled and dis-assembled.

12 Claims, 2 Drawing Sheets

U.S. PATENT DOCUMENTS

| | | | | |
|---|---|---|---|---|
| 7,692,173 | B2 * | 4/2010 | Fago et al. | 250/506.1 |
| 7,700,926 | B2 * | 4/2010 | Tartaglia et al. | 250/432 PD |
| 7,786,456 | B2 * | 8/2010 | Singh et al. | 250/507.1 |
| 7,812,322 | B2 * | 10/2010 | Wagner et al. | 250/432 R |
| 2008/0197302 | A1 * | 8/2008 | Fago et al. | 250/506.1 |
| 2008/0210891 | A1 * | 9/2008 | Wagner et al. | 250/507.1 |
| 2009/0069625 | A1 * | 3/2009 | Helle et al. | 600/7 |
| 2010/0019174 | A1 * | 1/2010 | Helle et al. | 250/506.1 |

FOREIGN PATENT DOCUMENTS

| | | |
|---|---|---|
| DE | 4039434 | 6/1992 |

* cited by examiner

SHIELDED CONTAINER

FIELD OF THE INVENTION

The present invention relates to the field of containers. More specifically, the present invention is directed to a shielded container for a radiopharmaceutical.

BACKGROUND OF THE INVENTION

Radio-pharmaceuticals are typically packaged in a manner that reduces radiation exposure to the end-user of the product. Because most of these pharmaceuticals have short half-lives, radioactive content can be extremely high during manufacturing and handling of these products. Packaging containers consists of several components, with the main component being lead. Lead has a very high density and provides excellent shielding characteristics for both gamma and beta emitting radio-pharmaceuticals. Lead is also very heavy and thus contributes to ergonomically related strains during container assembly and handling.

A radio-pharmaceutical container typically consists of an outer shell, an inner shell, and a product container. The outer shell is typically formed from plastic that is bother durable and cleanable. The outer shell is durable to meet the requirements of the Department of Transportation (DOT). The outer shell must contain and protect the inner contents of the package during shipping and use of the product. The outer shell is cleanable so that any radioactive contamination can be washed off of the surface. Radioactive contamination is a possibility due to the nature of the contents and the environment where the containers are used. The outer shell typically has a label containing all of the product information such as; product name, manufacturing date, volume, specific activity, etc. The outer shell is usually and injection molded component that contains sub-parts that are assembled into a lower and upper assembly.

The inner shell, also known as the shield, fits within the outer shell. The inner shell is typically manufactured from lead with a small percentage of antimony. The inner shell is designed to provide shielding of the radioactive contents of the container. The inner shell is usually poured from molten lead into a negative void, or form. The inner shell typically includes subparts which correspond to the subparts of the outer shell.

The product container is the primary holder of the product. It can be made of plastic or glass and can be sterile or non-sterile. The product container may be kept in the shipping container during use to reduce exposure to the end-user.

The container may also include an absorbent material placed inside the inner shell to absorb fluid if the product container is breached during shipment or use. There may also be a cushioning material, such as a sponge, to protect the product container from shock during shipment or use. Additionally, there may also be an inner sleeve that can be positioned between the inner shell and the product container to segregate the product container from the lead.

Because the actual dose to be carried by the container may greatly vary from use to use, the lead shield is typically formed to be very thick so as to handle all doses it may encounter. The resulting weight of the container presents greater risks to the assemblers or handlers of the container of ergonomic or repetitive stress injuries. As lead is a non-ferrous metal, the shielding containers of the prior art do not lend themselves to handling machinery which employ magnets for transporting, and handling components.

There is therefore a need in the art for a shielded container for a radiopharmaceutical which reduces operator exposure to the radiopharmaceutical and to ergonomic and repetitive stresses relating to the manufacture, assembly, and handling of the container.

SUMMARY OF THE INVENTION

In view of the needs of the art, the present invention provides a radiation-shielding container for a radiopharmaceutical that may be magnetically picked and placed.

One embodiment of the present invention provides a radiation-shielding container for storing and transporting a radiopharmaceutical. The container includes a cap and a base. The container includes a first ferromagnetic plug positioned adjacent to an outer surface of the shield of one of the cap shield and the base shield. The container may also include a second ferromagnetic plug positioned adjacent the other of the cap shield and the base shield. A plug of the present invention may be provided between the outer plastic shell of the container and the lead shield. The plug may be incorporated into the outer plastic shell. Alternatively, the plug may be attached to the outer surface of the outer liner. In this manner, the plug of the present invention may be retrofitted to prior art containers.

DETAILED DESCRIPTION OF THE PREFERRED EMBODIMENT

Figure 2:
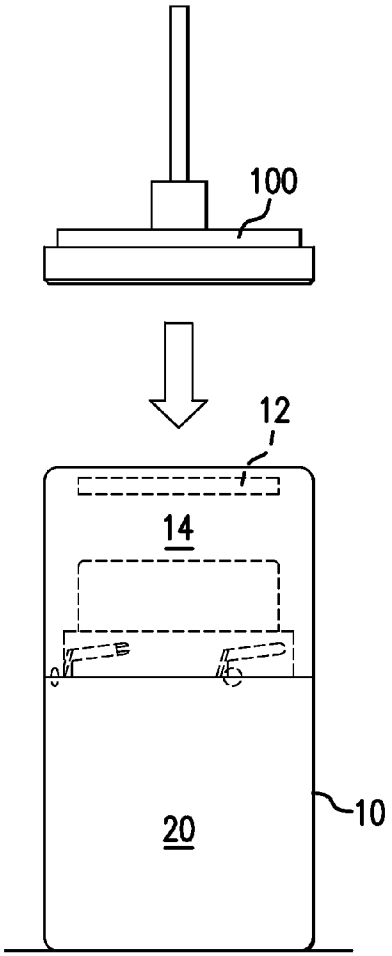
FIG. 2 shows the assembled product container of FIG. 1 waiting for handling.
Figure 1:
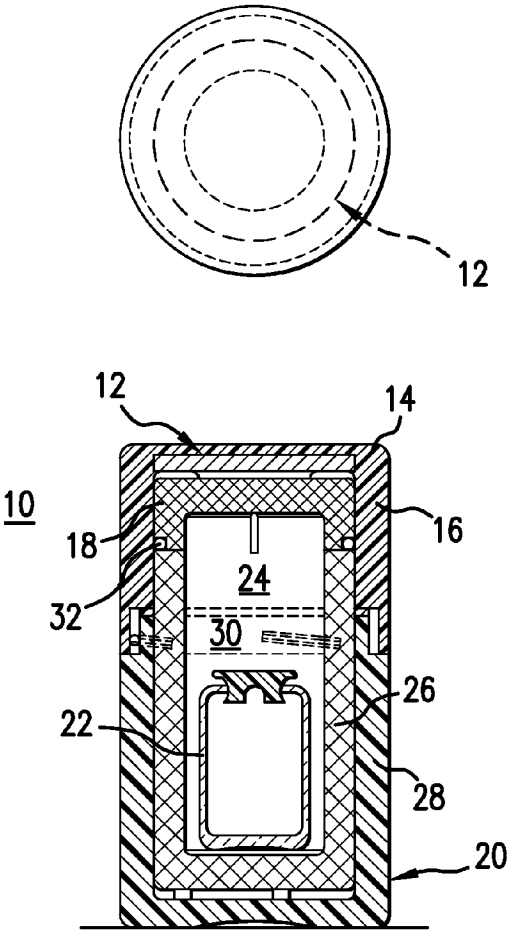
FIG. 1 depicts a common product container for shipping radioactive pharmaceuticals, with the addition of a steel plug that is inset into the cap of the plastic container.

FIG. 1 shows a shielded container 10 of the present invention for shipping radioactive pharmaceuticals. Container 10 includes a steel plug 12 that is inset into the cap 14 of the plastic outer shell 16. Plug 12 can be made of any ferrous material, or material that can be attracted to a magnetic field. FIG. 2 shows plug 10 as a component that is encapsulated within the cap 14 of the assembled container 10. Plug 12 does not affect the inner shell 18, or lead portion of the container so that the shielding ability of shielded container 10 is ensured. In addition, plug 12 does not affect the outer shell 16, or durable and cleanable, plastic portion of container 10. Outer shell 16 accommodates plug 12, whether plug 12 is to its inside, outside, or incorporated therein. Desirably, plug 12 is incorporated into container 10 during vendor assembly of the container so that an assembled cap 14 and base 20 will be provided to the production department for product filling and final assembly for a product container 22. Product container 22 is desirably a conventional container for a radioactive product such as a vial or a syringe or the like and is typically formed of plastic or glass and includes an elastomeric septum or piston.

More fully, container 10 includes a cap 14 and a base 20. Cap 14 includes a lead shield 18 and a plastic outer shell 16.

Cap 14 further defines an open cap cavity 24. Base 20 includes a lead shield 26 and an outers shell 28. Base 20 defines an open base cavity 30 in fluid communication with cap cavity 24 when cap 14 is mated to base 20. An elastomeric gasket 32 may be supported at the interface between cap 14 and base 20. It will be appreciated by those of ordinary skill in the art that container 10 may have other configurations for its cap and its base, such as including an inner plastic shell, lead shields fully encased within plastic, or a removable plastic sleeve insertable into cavity 30 and/or 24. The present invention provides a ferromagnetic plug 12 which enables the container to be remotely handled, manipulated and transported.

FIG. 2 shows the assembled product container 10 waiting for handling.

Figure 3:
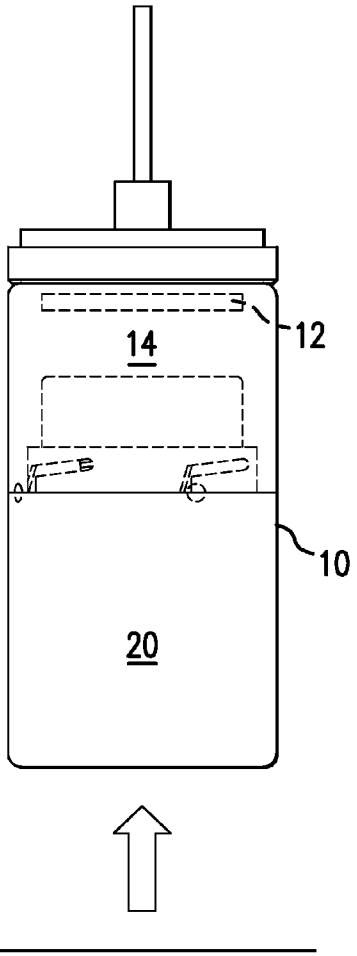
FIG. 3 shows a magnetic hoist/lift handling the product container of FIG. 1.

FIG. 3 shows a magnetic hoist/lift 100 handling container 10.

The purpose container 10 is to reduce the ergonomic and repetitive stress associated to the manufacture and handling of a radioactive product. Container 10 can weigh one pound or more, and a typical manufacturing lot may contain several hundred to several thousand product containers. The size of the container is such that single hand manipulation of the product container is common; however, the size may be up to several inches in diameter and/or length and thus ergonomically challenging when handling production volumes. The container 10 will minimize the operator whole body and extremity exposure incurred during manufacturing and handling of the product. In addition, container 10 will reduce the ergonomic and repetitive stress associated with the manufacturing and handling of the product. Finally, container 10 will offer these advantages to the end-user of these products as well as to those lading and assembling container 10.

While plug 12 is desirably incorporated into container 10 during the container's manufacture, plug 12 may also be added to an already existing product package. Plug 10 will thus allow for a different set of handling capabilities than shielded containers of the prior art which would forego use of a ferromagnetic material since such material does not provide desirable radiation shielding properties. These handling capabilities can vary in complexity from a remote pick and place mechanical arm to a robotic arm programmed to assemble, pick up, and place the product container into a shipping container. The added weight of the plug is insignificant when compared to the overall weight of the lead portion of the inner shell. It is possible that the plug could provide additional top shielding of the product container, or the dimension of the lead insert may be reduced because of the added shielding by the top plug.

Figure 5:
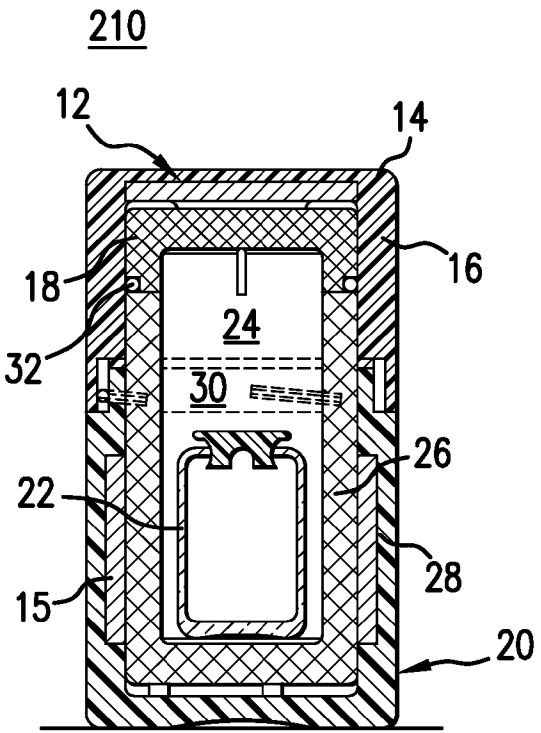
FIG. 5 depicts another embodiment of a product container of the present invention.
Figure 4:
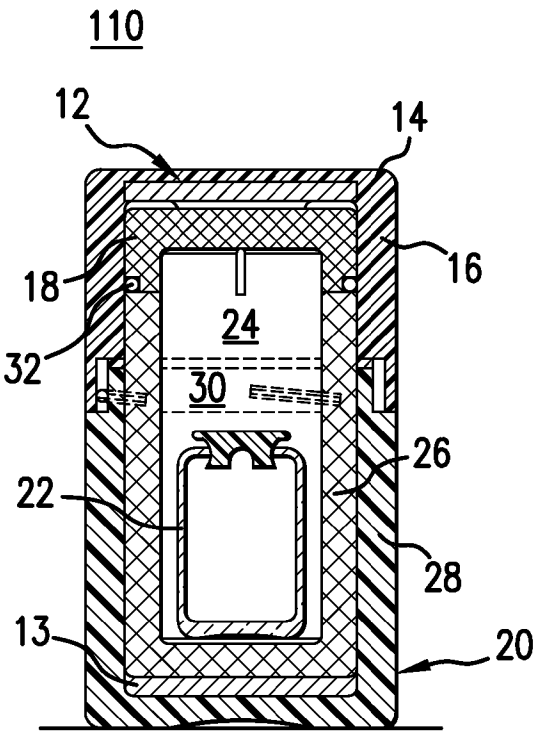
FIG. 4 depicts an alternate embodiment of a product container of the present invention.

As shown in FIG. 4, the present invention further contemplates providing a container 110 having a ferrous plug 13 incorporated in base 20. For this and the remaining embodiments (shown in FIGS. 5 and 6) of the present invention, the identifying nomenclature of container 10 is retained as shown. Container 110 is shown as further providing plug 13 to the components of container 10. Plug 13 allows for a sliding manipulation of either just the base 20 or the entire assembled and filled container 110. As shown in FIG. 5, the present invention alternatively contemplates providing a container 210 having a ferrous cylinder 15 incorporated between the cylindrical walls of base 20 and lower shield 26. Container 210 provides handling capabilities from the sides of container 210.

The present invention contemplates that the plugs 12, 13, and 15 of containers 10, 110, and 210, respectively may all be incorporated into a single container. Each of these containers provide a plastic outer surface when the containers are fully assembled, minimizing operator exposure to the lead shields while handling the container and providing an easily cleaned outer surface. While each of the shown containers show that the lead shield components provide an exposed lead surface on the interior, or container-receiving portion of the shields, the present invention is equally applicable to containers having an encapsulated or otherwise interiorly lined shield providing plastic on all of the surfaces to which an operator may be exposed.

Figure 6:
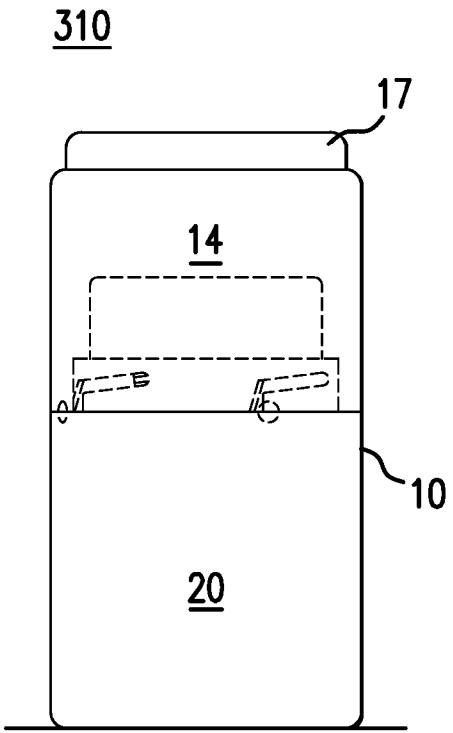
FIG. 6 depicts yet another embodiment of a product container of the present invention.

FIG. 6 depicts a container 310 of the present invention. Container 310 is a conventional shielded container of the prior art which has a ferrous plug 17 attached to the outside of the container. Attachment of plug 17 to container 210 may be accomplished by known adhesives or by other conventional means. While plug 17 is shown attached to cap 14, it is further contemplated that plug 17 may alternatively be attached to the exterior of base 20. The provision of plug 17 provides a simple retrofit of existing lead-shielded containers. Plug 17 itself may further be covered or encapsulated in plastic so as to maintain the general appearance and cleanliness of the original container.

The present invention thus provides the ability to use an automated or remote pick and place machine/device with shielded containers for radiopharmaceuticals. Such machines can provide for a reduction in manufacturing time and time spent handling product containers, thereby reducing the ergonomic and repetitive stress risks to human operators. These machines also provide the ability to handle numerous product containers at the same time. The containers may be manufactured and handled in an ergonomically correct way. The present invention thus provides production personnel are provided with the best possible methods and tools for handling radioactive pharmaceuticals While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A radiation-shielding container for storing and transporting a radiopharmaceutical, said container comprising:

a cap comprising an elongate cylindrical cap shield formed from a radiation-shielding material and having an open end defining a cap aperture and an opposed closed end, said cap shield including an outer cap shield surface and an inner cap shield surface, said inner cap shield surface defining a cap cavity in fluid communication with said cap aperture;

a base comprising an elongate cylindrical base shield formed from a radiation-shielding material and having an open end defining a base aperture and an opposed closed end, said base shield including an outer base shield surface and an inner base shield surface, said inner base shield surface defining a base cavity in fluid communication with said base aperture;

a first ferromagnetic plug positioned adjacent to an outer surface of one of said cap shield and said base shield.

2. A radiation-shielding container of claim 1, wherein said first plug is affixed to one of said cap shield and said base shield.

3. A radiation-shielding container of claim 1, wherein at least one of said cap shield and said base shield further comprise an outer liner about the outer surface of their respective shield.

4. A radiation-shielding container of claim 3, wherein said outer liner holds said first plug adjacent to the outer surface of said one of said cap shield and said base shield.

5. A radiation-shielding container of claim 3, wherein said first plug is affixed to said outer liner.

6. A radiation-shielding container of claim 4, wherein said outer liner encapsulates said first plug.

7. A radiation-shielding container of claim 4, wherein said outer liner defines a first plug cavity for receiving said first plug.

8. A radiation-shielding container of claim 1, further comprising a second ferromagnetic plug positioned adjacent to the other of said cap and said base as said first plug.

9. A radiation-shielding container of claim 1, wherein said first plug further comprises a substantially planar body having opposed first and second major surfaces.

10. A radiation-shielding container of claim 1, wherein said first plug further comprises a substantially cylindrical body at least partially accommodating at least a portion of said one of said cap shield and said base shield.

11. A radiation-shielding container of claim 1, wherein both said cap and said base further comprise an outer liner about the outer surface of their respective shields, said outer liners providing mating engagement between said cap and said base.

12. A radiation-shielding container of claim 11, wherein said plug is affixed to an outer surface of said liner.

* * * * *